US005614027A

United States Patent [19]

Dunn et al.

[11] Patent Number: 5,614,027

[45] Date of Patent: Mar. 25, 1997

[54] METAL CLEANER WITH NOVEL ANTI-CORROSION SYSTEM

[75] Inventors: Steven Dunn, Hillsborough; Anthony Winston, East Brunswick, both of N.J.

[73] Assignee: Church & Dwight Co., Inc., Princeton, N.J.

[21] Appl. No.: 311,253

[22] Filed: Sep. 23, 1994

[51] Int. Cl.[6] ..... C23G 1/16; C11D 3/04; C11D 3/28; C11D 3/34

[52] U.S. Cl. ..... 134/2; 134/29; 134/40; 510/255; 510/258; 510/259; 510/272; 510/423; 510/433; 510/434; 510/435; 510/437; 510/492; 510/500; 510/505

[58] Field of Search ..... 252/523, 541, 252/156, 174.23, 174.24, 174.14, 387, 389.2, 389.52, 389.62, 390, 394, 174.21, 173, 158, 542, 524, 171, 389.1, 389.61; 134/2, 40, 41, 42, 29; 510/255, 258, 259, 272, 423, 433, 434, 435, 437, 492, 500, 505

[56] References Cited

U.S. PATENT DOCUMENTS

| | | | |
|---|---|---|---|
| Re. 35,017 | 8/1995 | Winston et al. | 134/40 |
| 674,593 | 5/1901 | Bartelt | 252/135 |
| 2,037,566 | 4/1936 | Durgin | 252/135 |
| 4,283,299 | 8/1981 | Becker et al. | 252/90 |
| 4,575,569 | 3/1986 | Edwards | 568/45 |
| 4,681,704 | 7/1987 | Bernardino et al. | 252/546 |
| 4,756,846 | 7/1988 | Matsuura et al. | 252/156 |
| 4,931,205 | 6/1990 | Edwards et al. | 252/174.21 |
| 5,076,954 | 12/1991 | Loth et al. | 252/122 |
| 5,093,031 | 3/1992 | Login et al. | 252/357 |
| 5,133,892 | 7/1992 | Chun et al. | 252/90 |
| 5,230,824 | 7/1993 | Carlson, Sr. et al. | 252/174.21 |
| 5,234,505 | 8/1993 | Winston et al. | 134/40 |
| 5,269,962 | 12/1993 | Brodbeck et al. | 252/186.25 |
| 5,281,355 | 1/1994 | Tsaur et al. | 252/174.13 |
| 5,352,386 | 10/1994 | Rahman et al. | 252/548 |
| 5,385,959 | 1/1995 | Tsaur et al. | 523/201 |
| 5,431,836 | 7/1995 | Carr et al. | 252/174.14 |
| 5,431,847 | 7/1995 | Winston et al. | 252/174.24 |
| 5,484,555 | 1/1996 | Schepers | 252/541 |

FOREIGN PATENT DOCUMENTS

| | | |
|---|---|---|
| 0782898 | 9/1957 | United Kingdom . |

*Primary Examiner*—Ardith Hertzog
*Attorney, Agent, or Firm*—Irving M. Fishman

[57] ABSTRACT

A metal cleaning composition useful in aqueous solution comprises an alkalinity providing agent and a corrosion inhibitor comprising magnesium ions, zinc ions or both. The corrosion inhibitor is provided in the form of magnesium or zinc compounds such as magnesium oxide or water soluble salts thereof.

58 Claims, No Drawings

METAL CLEANER WITH NOVEL ANTI-CORROSION SYSTEM

BACKGROUND OF THE INVENTION

The present invention relates generally to aqueous metal cleaning compositions. In particular, this invention is directed to aqueous metal cleaning compositions useful in so-called parts washers which are particularly adapted to be used for industrial cleaning, as well as for domestic use.

Parts washers of various kinds are known to those skilled in the art as having great utility for mechanics and others working in a variety of occupations, particularly those working in industrial plants, maintenance and repair services, and the like. The parts washers referred to herein include soak tanks, so-called hot tanks, immersion type parts cleaners with or without air agitation, spray washers (continuous or batch) and ultrasonic baths. Generally, parts washers are used to remove all types of contaminants adhered to the metal surface including greases, cutting fluids, drawing fluids, machine oils, antirust oils such as cosmoline, carbonaceous soils, sebaceous soils, particulate matter, waxes, paraffins, used motor oil, fuels, etc.

Until recently, metal surfaces were cleaned of most oily and greasy contamination by use of solvents. Existing solvents, with or without special additives, are adequate to achieve good cleaning of most dirty, greasy, metal parts. A great number of solvents have been employed to produce metallic surfaces free from contamination. These wash solvents generally include various halogenated hydrocarbons and non-halogenated hydrocarbons, of significant quantity industry wide for cleaning and degreasing of the metal surfaces, and the degree of success with each of these wash solvents is generally dependent upon the degree of cleanliness required of the resultant surface.

Recently, however, the various hydrocarbon and halogenated hydrocarbon metal cleaning solvents previously employed have come under scrutiny in view of the materials employed, and in particular, the environmental impact from the usage of the various materials. This is particularly so in the case of parts cleaning which is done in closed environments such as garages and the like or for even home usage in view of the close human contact. Even the addition of devices to parts washers which can reduce spillage, fire and excessive volatilization of the cleaning solvent are not sufficient to alleviate present environmental concerns.

Although the halogenated hydrocarbon solvents such as chlorofluorocarbons (CFCs) and trichloromethane, methylene chloride and trichloroethane (methyl chloroform) are widely used in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

The non-halogenated hydrocarbon solvents such as toluene and Stoddard solvent and like organic compounds such as ketones and alcohols on the other hand are generally flammable, have high volatility and dubious ability to be recycled for continuous use. These, plus unfavorable safety, environmental and cost factors, put this group of solvents in a category which is unattractive for practical consideration. Most useful organic solvents are classified as volatile organic compounds (VOCs) which pollute the atmosphere, promote formation of toxic ozone at ground level, and add to the inventory of greenhouse gases.

In order to eliminate the various negative aspects of the known chemical washing and degreasing systems, it has, therefore, been suggested that an aqueous detergent system be used so as to overcome some of the inherent negative environmental and health aspects of prior art solvent cleaning systems. Unfortunately, aqueous cleaning systems are not without their own problems as related to use thereof in metal cleaning systems including use in parts washers as described above. For example, certain of the aqueous cleaners are exceedingly alkaline having pHs of 13 and above such as sodium hydroxide or include organic solvents such as alkanolamine, ethers, alcohols, glycols, ketones and the like. Besides being highly corrosive, the exceedingly high alkaline aqueous solutions are highly toxic and can be dangerous to handle requiring extreme safety measures to avoid contact with skin. Organic solvent-containing aqueous cleaners present the problems regarding toxicity, volatility or the environment as expressed previously. On the other hand, it is most difficult to obtain an aqueous detersive solution at moderate pH which is effective in removing the greases and oils which contaminate metal including metal engine parts and which would not be corrosive to the metal substrate.

One particular disadvantage of using aqueous systems to clean metal surfaces is the potential to corrode or discolor the surfaces. While aqueous cleaning solutions having a high pH such as formed from sodium hydroxide are often more corrosive than aqueous solutions having a relatively low pH such as formed by mildly alkaline detergents, corrosion and discoloration are still problematic with the more mild solutions. Various corrosion inhibitors are known and have been used to prevent corrosion of surfaces which come into contact with aqueous alkaline solutions. Probably, the most effective and least costly of the known corrosive inhibitors are the silicates, such as alkali metal silicates. Unfortunately, the alkali metal silicates begin to precipitate from aqueous solution at pHs below 11, thus, greatly reducing the effectiveness of these materials to prevent corrosion of the contacted surfaces when used in aqueous cleaning solutions having a lower pH. Accordingly, to be as effective and be able to replace the halogenated and hydrocarbon solvents now widely used, aqueous metal cleaning compositions will have to be formulated to solve the problems associated therewith including efficacy of detersive action at moderate pH levels and the corrosiveness inherent in aqueous based systems, in particular, on metal substrates.

Accordingly, it is an object of this invention to provide an aqueous metal cleaning composition which is effective to clean grease, oil and other contaminants from a metal surface without being excessively corrosive to the substrate and irritating to human skin.

Another object of the invention is to provide an aqueous metal cleaning composition which can be used effectively in a variety of parts washing equipment so as to efficiently remove grease, oil and other contaminants from metal parts and which is safe to use and not a hazard to the environment in use or upon disposal.

Still another object of the present invention is to provide an aqueous metal cleaning composition which contains an effective corrosion inhibitor.

Still yet another object of the present invention is to provide an aqueous metal cleaning composition of moderate pH which has effective detersive action and which can provide effective corrosion protection to the metal substrate being cleaned.

A further object of this invention is to provide a method of imparting corrosion protection to metal surfaces from aqueous solution.

SUMMARY OF THE INVENTION

The above-mentioned objectives and other objects are obtained in accordance with the present invention by providing an aqueous alkaline metal cleaning solution which has a pH of up to 11 but a sufficiently high pH to effectively clean dirt, grease, oil and the like from metal parts and which includes a metal corrosion inhibitor effective in mildly alkaline aqueous solutions. Magnesium and/or zinc ions have surprisingly been found to be effective as corrosion inhibitors in mildly alkaline aqueous solutions. While the magnesium and zinc ions are effective when used separately, combinations of the two metals provide advantageous corrosion protection for the metal substrate. Unlike the halogenated or hydrocarbon solvents of the prior art, the aqueous alkaline cleaning solutions of this invention are environmentally safe in use and have only low amounts of organics which do not readily volatilize and which are safe on disposal thereof.

The aqueous metal cleaning compositions of the present invention comprise an alkalinity providing agent and either one or both of magnesium or zinc ions which act as a corrosion inhibitor. The addition of a polycarboxylated polymer has been found useful in preventing the precipitation of the magnesium and/or zinc metals from the mildly alkaline solutions of this invention. Preferably, the detersive ability of the aqueous alkaline cleaning composition is enhanced by the addition of a surfactant. Particularly useful surfactants which can be used in the cleaning composition of this invention are ones which are low foaming and do not readily emulsify the oil and grease being removed so as to allow such grease and oil to be skimmed from the wash bath for disposal. Consequently, the cleaning ability of the aqueous cleaner can be maintained for prolonged reuse.

DETAILED DESCRIPTION OF THE INVENTION

The aqueous cleaning compositions of the present invention comprise an alkalinity providing agent and a corrosion inhibitor selected from water soluble magnesium compounds, zinc compounds and combinations thereof.

The metal cleaning compositions of the present invention are useful for removing any type of contaminant from a metal surface including greases, cutting fluids, drawing fluids, machine oils, antirust oils such as cosmoline, carbonaceous soils, sebaceous soils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein the metal surfaces have to be cleaned.

Treatment of aluminum surfaces with the compositions of this invention has been found particularly effective.

The aqueous alkaline metal cleaning solutions of this invention comprising the cleaning composition in water have a pH above 7.5 and up to 11.0 so as to render these solutions substantially less harmful to use and handle than highly alkaline aqueous cleaners such as those formed from sodium hydroxide or aqueous alkanolamine solutions. The solutions preferably have a pH of at least 8.0 to less than 11.0 to effectively clean the typical metal substrates. Most preferably, the aqueous alkaline cleaning solutions have a pH from about 8.0 to 10.0 which is effective to remove the dirt, grease, oil and other contaminants from the metal surface without causing tarnishing or discoloration of the metal substrate and yet allow the solutions to be used, handled and disposed of without burning or irritating human skin. It is preferable that the compositions and resultant aqueous cleaning solutions formed therefrom be free of organic solvents including hydrocarbon, halohydrocarbon and oxygenated hydrocarbon solvents.

The alkalinity providing agent of the aqueous metal cleaning compositions of the present invention can be provided by one or more alkaline salts. Suitable alkaline salts or mixtures thereof useful in the present invention are those capable of providing the desired pH. Most suitable are the salts of potassium and sodium. Especially preferred are the potassium and sodium carbonates and bicarbonates which are economical, safe and environmentally friendly. The carbonate salts include potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used include the alkali metal ortho or complex phosphates. Examples of alkali metal orthophosphates include trisodium or tripotassium orthophosphate. The complex phosphates are especially effective because of their ability to chelate water hardness and heavy metal ions. The complex phosphates include, for example, sodium or potassium pyrophosphate, tripolyphosphate and hexametaphosphates. It is preferred to limit the amount of phosphates to less than 1 wt. % (phosphorus) relative to the total alkaline salts used inasmuch as phosphates are ecologically undesirable being a major cause of eutrophication of surface waters. Additional suitable alkaline salts useful in the metal cleaning compositions of this invention include the alkali metal borates, acetates, citrates, tartrates, succinates, phosphonates, edates, etc. It is preferred to maintain the compositions of this invention silicate-free due to the resultant high pH and difficulty in formulating a composition which will remain soluble in aqueous solution at pH's of 11.0 or less when silicates are present.

The corrosion inhibitors added to the aqueous metal cleaning compositions of this invention include magnesium and/or zinc ions. Preferably, the metal ions are provided in water soluble form. Examples of useful water soluble forms of magnesium and zinc ions are the water soluble salts thereof including the chlorides, nitrates and sulfates of the respective metals. If the alkalinity providing agents are the alkali metal carbonates, bicarbonates or mixtures of such agents, magnesium oxide can be used to provide the Mg ion. The magnesium oxide is water soluble in such solutions and is a preferred source of Mg ions. The magnesium oxide appears to reduce discoloration of the metal substrates even when compared with the chloride salt.

In order to maintain the dispersibility of the magnesium and/or zinc corrosion inhibitors in aqueous solution, in particular, under the mildly alkaline pH conditions most useful in this invention and in the presence of agents which would otherwise cause precipitation of the zinc or magnesium ions, e.g., carbonates, phosphates, etc., it has been found advantageous to include a carboxylated polymer to the solution. The useful carboxylated polymers may be generically categorized as water-soluble carboxylic acid polymers such as polyacrylic and polymethacrylic acids or vinyl addition polymers. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersible in water. The molecular weight of these polymers may vary over a broad range although it is preferred to use polymers having average molecular weights ranging between 1,000 up to 1,000,000. In a preferred embodiment of the invention these polymers have a molecular weight of 100,000 or less and, most preferably, between 1,000 and 10,000.

The water-soluble polymers of the type described above are often in the form of copolymers which are contemplated as being useful in the practice of this invention provided they contain at least 10% by weight of $$-\overset{\overset{\displaystyle O}{\|}}{C}-OM$$

groups where M is hydrogen, alkali metal, ammonium or other water-solubilizing radicals. The polymers or copolymers may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419, 502.

As previously stated, maleic anhydride polymers are preferred. Especially useful maleic consisting of homopolymers of maleic anhydride, and copolymers of maleic anhydride with vinyl acetate, styrene, ethylene, isobutylene, acrylic acid and vinyl ethers. These polymers can be easily prepared according to standard methods of polymerization.

The carboxylated polymers aid in maintaining the magnesium and zinc compounds in solution, thereby preventing the precipitation of the corrosion inhibitor from solution and consequent degradation of corrosion protection. Further, the carboxylated polymers prevent scaling due to precipitation of water hardness salts formed during reaction with the alkaline salts of the cleaning compositions of this invention.

To improve cleaning efficacy of the cleaning compositions of the present invention, it is preferred to add one or more surfactants. Nonionic surfactants are preferred as such surfactants are best able to remove the dirt, grease and oil from the metal substrates.

Among the most useful surfactants in view of the ability thereof to remove grease and oil are the nonionic alkoxylated thiol surfactants. The nonionic alkoxylated (ethoxylated) thiol surfactants of the present invention are known and are described for example in U.S. Pat. Nos. 4,575,569 and 4,931,205, the contents of both of which are herein incorporated by reference. In particular, the ethoxylated thiol is prepared by the addition of ethylene oxide to an alkyl thiol of the formula R—SH wherein R is alkyl in the presence of either an acid or base catalyst. The thiol reactant that is suitable for producing the surfactant used in the practice of the present invention comprises, in the broad sense, one or more of the alkane thiols as have heretofore been recognized as suitable for alkoxylation by reaction with alkylene oxides in the presence of basic catalysts. Alkane thiols in the 6 to 30 carbon number range are particularly preferred reactants for the preparation of thiol alkoxylates for use as surface active agents, while those in the 7 to 20 carbon number range are considered more preferred and those in the 8 to 18 carbon number range most preferred.

Broadly, the surfactant can be formed from reaction of the above alkyl thiol and one or more of the several alkylene oxides known for use in alkoxylation reactions with thiols and other compounds having active hydrogen atoms. Particularly preferred are the vicinal alkylene oxides having from 2 to 4 carbon atoms, including ethylene oxide, 1,2-propylene oxide, and the 1,2- and 2,3-butylene oxides. Mixtures of alkylene oxides are suitable in which case the product will be mixed thiol alkoxylate. Thiol alkoxylates prepared from ethylene or propylene oxides are recognized to have very advantageous surface active properties and for this reason there is a particular preference for a reactant consisting essentially of ethylene oxide which is considered most preferred for use in the invention.

The relative quantity of thiol and alkylene oxide reactants determine the average alkylene oxide number of the alkoxylate product. In the alkoxylated thiol surfactant of this invention an adduct number in the range from about 3 to 20, particularly from about 3 to 15 is preferred. Accordingly, preference can be expressed in the practice of the invention for a molar ratio of alkylene oxide reactant to thiol reactant which is in the range from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Unfortunately, the ethoxylated thiol surfactant has an unpleasant odor which is imparted to the aqueous solution in which it is placed. It has been found that the addition of a nitrogen-containing surfactant eliminates the odor of the sulfur-containing surfactant and does not adversely effect the efficacy of the ethoxylated thiol surfactant to remove grease, oil and the like from the metal surfaces. Among useful nitrogen-containing nonionic surfactants are the following:

A surfactant having a formula $R^1R^2R^3N\rightarrow 0$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and $R^3$ are selected from the group consisting of alkyl radicals and hydroxyalkyl radicals containing from one to about three carbon atoms.

Specific examples of amine oxide surfactants include: Dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropyl amine oxide, (2-hydroxypropyl)methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, nonionic surfactants derived from the condensation of ethylene oxide with the product resulting from the reaction of propylene oxide and ethylene diamine are also useful. For example, compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000 are satisfactory.

One of the most useful nitrogen-containing surfactants are those derived from N-alkyl pyrrolidone. This surfactant is one which can be used alone to achieve excellent cleaning or used in combination with the ethoxylated thiol surfactant. Particularly preferred is N-(n-alkyl)-2-pyrrolidone wherein the alkyl group contains 6–15 carbon atoms. These compounds are described in U.S. Pat. No. 5,093,031 assigned to ISP Investments, Inc., Wilmington, Del. and which discloses surface active lactams and is herein incorporated by reference. The above N-alkyl pyrrolidone products having a molecular weight of from about 180 to about 450 are conveniently prepared by several known processes including the reaction between a lactone having the formula

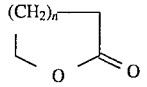

wherein n is an integer from 1 to 3, and an amine having the formula R'—$NH_2$ wherein R' is a linear alkyl group having 6 to 20 carbon atoms. The amine reactant having the formula R'—$NH_2$ includes alkylamines having from 6 to 20 carbon atoms; amines derived from natural products, such as coconut amines or tallow amines distilled cuts or hydrogenated derivatives of such fatty amines. Also, mixtures of amine reactants can be used in the process for preparing the pyrrolidone compounds.

Generally, the $C_6$ to $C_{14}$ alkyl pyrrolidones have been found to display primarily surfactant properties; whereas the $C_{16}$ to $C_{22}$ alkyl species are primarily complexing agents; although some degree of surfactants and complexing capability exists in all of the present species.

The relative amounts of the ethoxylated thiol surfactant and nitrogen-containing surfactant if used in combination are not overly critical as far as a contrite range is concerned in that the amount of the nitrogen surfactant will vary depending on the surfactant used. The amount of nitrogen-containing surfactant used should be that which can reduce if not eliminate the odor of the ethoxylated thiol surfactant. In general, it is believed that the relative amounts by weight of the ethoxylated thiol surfactant to the nitrogen-containing surfactant should range from about 1.0:0.1 to 1.0:2.0, and preferably from about 1.0:0.2 to 1:1. It is not meant that these ratios are to be considered as strictly limiting the invention and as providing the only relative amounts of the respective surfactants which can be effectively used and accordingly, it is intended that any useful ratio be considered part of the present invention. Any useful ratio is that ratio which is sufficient to remove the dirt, grease, oil and other contaminants from the metal surface and which will yield an aqueous product which has greatly reduced malodor relative to an equivalent composition in which the ethoxylated thiol surfactant is present and the nitrogen-containing surfactant is not.

Other surfactants can be used in the compositions of this invention other than or in addition to the above described surfactants. Especially preferred are surfactants which do not readily emulsify the contaminants removed from the metal surface so that such contaminants readily separate from the cleaning solution. The separated contaminants can then be easily skimmed or otherwise easily separated from the wash bath for disposal. Consequently, the cleaning ability of the aqueous cleaner can be maintained for prolonged reuse. It is believed that most of the ethoxylated surfactants do not substantially emulsify the removed contaminants.

Suitable non-ionic surfactants include the polyoxyethylene-polyoxypropylene condensates, which are sold by BASF under the tradename "Pluronic", polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide. Examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate sold by W. R. Grace under the tradename "Hamposyl". Also effective are polycarboxylated ethylene oxide condensates of fatty alcohols manufactured by Olin under the tradename of "Polytergent CS-1". It is most preferred that the aqueous cleaning solutions of this invention be low foaming during use. Accordingly, the sulfate and sulfonate surfactants may not always be acceptable if the cleaning process involves agitation of the cleaning solution.

Besides the alkalinity providing agent corrosion inhibitor and optional carboxylated polymer and surfactant as described above, the aqueous metal cleaning compositions of the present invention preferably include a hydrotrope. In use, the dry ingredients of the invention are provided in solution in water which is preferably deionized or purified by reverse osmosis treatment and the like.

The hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam. Among the most useful of such hydrotropes are those which comprise the alkali metal salts of intermediate chain length linear alkyl monocarboxylic fatty acids, i.e., $C_7$–$C_{13}$. Particularly preferred are the alkali metal octanoates and nonanoates.

The metal cleaning compositions of this invention comprise from about 20 to 80 weight percent based on the dry components of the alkalinity providing agent, 1 to 10 weight % of the corrosion inhibitor compound, 0 to 80 weight %, preferably 5 to 80 weight % surfactant, 0–5 weight percent, preferably, 0.3 to 2 weight percent of the polycarboxylate and 0–30 weight percent, preferably, 2–25 weight percent of the hydrotrope. The dry composition is used in the aqueous wash solution in amounts of about 0.1–20 weight percent, preferably from about 0.2–5 weight percent. Most preferably, the metal cleaning compositions of the present invention are provided and added to the wash bath as an aqueous concentrate in which the dry components of the composition comprise from about 5–45 weight percent of the concentrate and, preferably, from about 5–20 weight percent.

If the alkalinity providing agent is the preferred carbonate and bicarbonate salts, the combination of such salts should be present in the amounts of 20–80 percent by weight. Preferably, if such a mixture is utilized the amount of bicarbonate salts should comprise from about 5–80 weight percent and the carbonate salts from about 5–60 percent by weight based on the dry composition.

Individually, the magnesium and zinc compound corrosion inhibitors are added to the composition in different amounts. Thus, the magnesium compound will typically be added to the composition in amounts of 1 to 10 weight % whereas the zinc compound should be present in amounts of from 0.8 to 1.5 weight % of the composition. The amount of the magnesium and zinc added for corrosion protection can best be described by referring to the levels of the respective ions with respect to the cleaning solutions. Thus, useful levels of magnesium ion for producing an anticorrosive effect are between about 25 and 1,000 ppm with respect to the aqueous cleaning solution. It is preferable to use between about 50 and 200 ppm magnesium in solution. It is to be understood that higher levels of the magnesium ion can be included in the aqueous solution but for the most part, higher levels than that described are not believed to add significantly to the anticorrosive effect. The zinc ion is effective at concentrations between 1 and 1,000 ppm with respect to the aqueous cleaning solution. Again, higher levels of the zinc ion can be used but such higher levels are not believed to increase the anticorrosive effect. When used alone, the zinc ion is preferably utilized in concentrations of 25 to 100 ppm in the cleaning solution. When used with magnesium, the zinc ion levels are preferably from about 2 to 25 ppm based on the cleaning solution.

The aqueous metal cleaning solutions of the present invention are useful in removing a variety of contaminants from metal substrates as previously described. A useful method of cleaning such metal parts is in a parts washer. In parts washers the metal parts are contacted with the aqueous solution either by immersion or some type of impingement in which the aqueous cleaning solution is circulated or continuously agitated against the metal part or is sprayed thereon. Alternatively, agitation can be provided as ultrasonic waves. The cleaning solution is then filtered and recycled for reuse in the parts washer.

For best use, the aqueous cleaning solutions of this invention should be at an elevated temperature typically ranging from about 90°–180° F. The contact time of the aqueous cleaning solution with the metal substrates will vary depending upon the degree of contamination but broadly will range between about 1 minute to 30 minutes with 3 minutes to 15 minutes being more typical.

EXAMPLES 1 TO 5 AND CONTROL EXAMPLES 1 AND 2

The following examples show the effectiveness of magnesium and zinc ions in preventing corrosion and discoloration of aluminum and anodized aluminum surfaces when exposed to alkaline solutions.

Initially metal test coupons were accurately weighed on a balance. The test coupons were then immersed for 15 minutes in a stirred 10% solution of the test products in deionized water held at 160° F. The coupons were recovered from the test solution, thoroughly rinsed in distilled water and allowed to dry. The coupons were then reweighed and examined for signs of corrosion.

The test products as aqueous concentrates and results of testing for each of the examples and controls are shown in Tables 1 and 2 (concentrates) and Table 3 (results). In Table 3, negative numbers indicate weight loss, therefore, corrosion. Positive numbers indicate weight gain, therefore, deposition. Weight changes of less than 0.025% were not significant.

TABLE 1

| | Examples | | | | |
|---|---|---|---|---|---|
| | I | II | III | IV | V |
| Water | 76.68 | 77.71 | 77.92 | 78.63 | 76.61 |
| Sodium bicarbonate | 7.36 | 7.36 | 7.36 | 6.85 | 5.60 |
| Potassium carbonate | 1.96 | 1.96 | 1.96 | 1.96 | 3.62 |
| Sodium carbonate | 1.60 | 1.60 | 1.60 | 1.60 | 2.78 |
| Magnesium chloride | 1.55 | 0.62 | 0.41 | 0.00 | 0.62 |
| Zinc chloride | 0.00 | 0.00 | 0.00 | 0.21 | 0.02 |
| Alcosperse 408[1] | 0.25 | 0.25 | 0.25 | 0.25 | 0.25 |
| Sodium nonanoate | 6.00 | 6.00 | 6.00 | 6.00 | 6.00 |
| Alcodet 260[2] | 3.00 | 3.00 | 3.00 | 3.00 | 3.00 |
| ISP LP-100[3] | 1.50 | 1.50 | 1.50 | 1.50 | 1.50 |

[1]Acrylic acid polymer, MW 2,500–4,500, Alco Chemical Corp., Chatanooga, TN
[2]Ethoxylated dodecyl mercaptan (6 ethylene oxide units), Rhone-Poulenc.
[3]N-alkyl pyrrolidone, ISP

TABLE 2

| | Controls | |
|---|---|---|
| | I | II |
| Water | 75.75 | 70.96 |
| Sodium hydroxide | 0.00 | 0.40 |
| Sodium bicarbonate | 7.36 | 0.00 |
| Potassium carbonate | 1.96 | 7.81 |
| Sodium carbonate | 1.60 | 6.38 |
| Magnesium chloride | 0.00 | 0.00 |
| Zinc chloride | 0.00 | 0.00 |
| Alcosperse 408 | 0.20 | 0.50 |
| Carbopol Ex 368 | 0.00 | 0.45 |
| Potassium silicate | 0.00 | 2.50 |
| Sodium nonanoate | 7.50 | 7.50 |
| Alcodet 260 | 3.75 | 0.00 |
| ISP LP-100 | 1.88 | 2.00 |
| Olin SL-92 | 0.00 | 1.50 |

TABLE 3

| | Weight Change & Aluminum Type | | | Visual appearance Aluminum Type | | |
|---|---|---|---|---|---|---|
| | 1100 | 5052 | 6061 anodized | 1100 | 5052 | 6061 anodized |
| Example I | +0.052 | +0.013 | −0.026 | slight blochiness | | |
| Example II | −0.006 | 0.000 | −0.026 | V. sl. discl. | | Sl. bloch. |
| Example III | 0.000 | +0.007 | −0.018 | Sl. discl. | | Sl. bloch |
| Example IV | −0.013 | −0.013 | −0.008 | Sl. discl. | | OK |
| Example V | −0.006 | −0.006 | −0.015 | OK | OK | OK |
| Control I | −0.624 | −0.331 | −0.605 | Visible corrosion | | |
| Control I* | −0.058 | −0.039 | −0.100 | Darkened | Darkened | OK |
| Control II | +0.019 | 0.013 | −0.015 | OK | OK | OK |

*Done in tap water

Referring to Table 3, the results show that Example formulations of the present invention containing either magnesium, zinc or combinations of magnesium and zinc were significantly less corrosive to aluminum and anodized aluminum than the control formulations (I) which did not contain an anti-corrosion agent. Corrosion of the test coupons was reduced in hard water. However, the addition of the magnesium and zinc ions reduced corrosion beyond that resulting from washing in hard water. The anti-corrosive effects of magnesium and zinc were comparable with that of silicates (Control II). The use of combinations of magnesium and zinc prevented discoloration of aluminum in addition to providing an anticorrosive effect.

EXAMPLE 6 AND CONTROL EXAMPLE 3

To determine the upper pH limit for effectiveness of magnesium ions in preventing corrosion of aluminum the following study was run.

Formulation concentrates were prepared as follows:

| | Example VI | Control Example III |
|---|---|---|
| Deionized water | 81.910 | 80.58 |
| Sodium bicarbonate | 4.480 | 7.36 |
| Potassium carbonate | 2.900 | 1.96 |
| Sodium carbonate | 2.220 | 1.60 |
| Magnesium oxide | 0.074 | 0.00 |
| Carboxylate[1] | 0.250 | 0.00 |
| Sodium nonanoate | 3.000 | 3.00 |
| Alcodet 260 | 3.000 | 3.00 |
| LP 100 | 1.500 | 1.50 |

[1]A polycarboxylated copolymer containing acrylic and maleic acid units and having a molecular weight of about 4,500.

For each test the formulations were diluted to 10% in deionized water and the pH of the resulting solution was adjusted for each test cell as needed. Three aluminum test coupons were immersed in each solution at 160° F. for 15 minutes and the weight loss determined.

| Results | | | |
|---|---|---|---|
| Solution pH | Aluminum type | Example VI with MgO | Control Example III without MgO |
| 10.0 | 1100 | +0.0377 | −1.5384 |
| | 5052 | +0.0064 | −0.4969 |
| | 6061 (anodized) | −0.0175 | −1.3691 |
| 10.5 | 1100 | −1.4007 | −1.8606 |
| | 5052 | −0.3367 | −0.6365 |
| | 6061 (anodized) | −1.0227 | −2.2258 |
| 11.0 | 1100 | −2.1391 | −2.2885 |
| | 5052 | −0.6223 | −0.7520 |
| | 6061 (anodized) | −2.4075 | −2.2915 |
| 11.5 | 1100 | −2.6147 | −2.5683 |
| | 5052 | −0.9634 | −0.9761 |
| | 6061 (anodized) | −2.2410 | −2.1636 |
| 12.0 | 1100 | −3.6258 | −3.0449 |
| | 5052 | −1.9953 | −1.4291 |
| | 6061 (anodized) | −3.0888 | −2.5912 |

The results show that magnesium ions inhibit the corrosion of the aluminum coupons at pHs up to about 10.5. Above this pH value, the addition of magnesium ions is not apparently effective in inhibiting corrosion of aluminum.

What is claimed is:

1. A method of cleaning aluminum or aluminum alloy substrates so as to remove contaminants therefrom comprising: contacting said substrates with an aqueous cleaning solution comprising a metal cleaning composition in water, said metal cleaning composition containing an alkoxylated thiol surfactant, and an N-alkyl pyrrolidone surfactant, an alkalinity providing agent and a corrosion inhibitor selected from the group consisting of magnesium ions, zinc ions and mixtures thereof, said contacting occuring for a sufficient time to remove said contaminants from said substrates.

2. The method of claim 1 wherein said corrosion inhibitor is in the form of water soluble salts of magnesium or zinc.

3. The method of claim 2 wherein said water soluble salts comprise magnesium chloride or zinc chloride.

4. The method of claim 1 wherein said magnesium ion is provided in amounts of from 25 to 1,000 ppm based on said aqueous cleaning solution or said zinc ion is provided in amounts of from 1 to 1,000 ppm based on said aqueous cleaning solution.

5. The method of claim 4 wherein only magnesium ions are provided as the corrosion inhibitor.

6. The method of claim 4 wherein magnesium and zinc ions are provided as the corrosion inhibitor.

7. The method of claim 4 wherein only zinc ions are provided as the corrosion inhibitor.

8. The method of claim 1 wherein said alkalinity providing agent comprises alkali metal carbonate, alkali metal bicarbonate or mixtures thereof.

9. The method of claim 8 wherein said corrosion inhibitor comprises magnesium ions in the form of magnesium oxide.

10. The method of claim 1 wherein said aqueous cleaning solution contains 0.1 to 20 wt. % of said metal cleaning composition and has a pH of between 7.5 and 10.5.

11. The method of claim 10 wherein said aqueous cleaning solution has a pH of from about 8.0 to about 10.

12. The method of claim 10 wherein said aqueous cleaning solution is at a temperature of from about 90° to 180° F. and said substrates are contacted with said aqueous cleaning solution for about 1 to 30 minutes.

13. The method of claim 1 wherein said substrates are contacted with said aqueous cleaning solution in a parts washer by immersion, impingement or both, said substrates are removed from said parts washer and said aqueous cleaning solution is reused in said parts washer to clean additional metal substrates.

14. The method of claim 13 wherein said substrates are sprayed with said aqueous cleaning solution.

15. The method of claim 1 wherein said surfactants do not substantially emulsify said contaminants in said cleaning solution whereby said contaminants readily separate from said cleaning solution.

16. The method of claim 15 wherein said alkoxylated thiol surfactant comprises an ethoxylated alkyl thiol having 7 to 20 carbon atoms and ethoxylated with 3 to 15 ethylene oxide units.

17. The method of claim 1 wherein said metal cleaning composition comprises 20 to 80 wt. % of said alkalinity providing agent, 0.1 to 10 wt. % of a corrosion inhibitor comprising magnesium or zinc compounds, 5 to 80 wt. % of the surfactants, 0 to 5 wt. % of a polycarboxylate and 0 to 30 wt. % of a hydrotrope.

18. The method of claim 17 wherein said metal cleaning composition comprises 0.3 to 3 wt. % of said polycarboxylate.

19. The method of claim 17 wherein said metal cleaning composition is free of silicates and said alkalinity providing agent comprises less than 1 wt. % phosphorus.

20. A method of cleaning metal substrates so as to remove contaminants therefrom comprising: contacting said substrates with an aqueous cleaning solution comprising a metal cleaning composition in water, said metal cleaning composition comprising an alkoxylated thiol surfactant, an N-alkyl pyrrolidone surfactant, an alkalinity providing agent, a corrosion inhibitor selected from the group consisting of magnesium ions, zinc ions and mixtures thereof and a carboxylated polymer to maintain said corrosion inhibitor in solution.

21. The method of claim 20 wherein said alkalinity providing agent comprises alkali metal carbonate, alkali metal bicarbonate or mixtures thereof.

22. The method of claim 21 wherein said corrosion inhibitor comprises magnesium ions in the form of magnesium oxide.

23. The method of claim 20 wherein said aqueous solution contains 0.1 to 20 wt. % of said metal cleaning composition and has a pH of between 7.5 and 11.0.

24. The method of claim 23 wherein said aqueous cleaning solution is at a temperature of from about 90° to 180° F. and said metal substrates are contacted with said aqueous cleaning solution for about 1 to 30 minutes.

25. The method of claim 20 wherein said magnesium ion is provided in amounts of from 25 to 1,000 ppm based on said aqueous cleaning solution or said zinc ion is provided in amounts of from 1 to 1,000 ppm based on said aqueous cleaning solution.

26. The method of claim 20 wherein said metal substrates are contacted with said aqueous cleaning solution in a parts washer by immersion, impingement or both, said substrates are removed from said parts washer and said aqueous cleaning solution is reused in said parts washer to clean additional metal substrates.

27. The method of claim 26 wherein said substrates are sprayed with said aqueous cleaning solution.

28. An aqueous metal cleaning solution comprising 0.1 to 20 wt. % of a metal cleaning composition and the balance water, said metal cleaning composition comprising an alkoxylated thiol surfactant, N-alkyl pyrrolidone surfactant, an alkalinity providing agent, a corrosion inhibitor selected from the group consisting of magnesium ions, zinc ions and a mixture thereof, and a carboxylated polymer to maintain said corrosion inhibitor in solution, said solution having a pH of from 7.5 to 11.0.

29. The solution of claim 28 wherein said alkalinity providing agent comprises alkali metal carbonate, alkali metal bicarbonate or mixtures thereof.

30. The solution of claim 29 wherein said corrosion inhibitor comprises magnesium ions in the form of magnesium oxide.

31. The solution of claim 28 wherein said corrosion inhibitor is in the form of water soluble salts of magnesium or zinc.

32. The solution of claim 28 wherein said magnesium ion is provided in amounts of from 25 to 1,000 ppm based on said aqueous cleaning solution or said zinc ion is provided in amounts of from 1 to 1,000 ppm based on said aqueous cleaning solution.

33. The solution of claim 28 wherein said metal cleaning composition comprises 20 to 80 wt. % of said alkalinity providing agent, 0.1 to 10 wt. % of said corrosion inhibitor in the form of magnesium or zinc compounds, 5 to 80 wt. % of the surfactants, 0.3 to 2 wt. % of said carboxylated polymer and 0 to 30 wt. % of a hydrotrope.

34. The solution of claim 28 wherein said aqueous cleaning solution has a pH of from about 8 to about 10.

35. An aqueous metal cleaning concentrate comprising: 5–45 wt. % of a metal cleaning composition and the balance water, said metal cleaning composition comprising an alkoxylated thiol surfactant, an N-alkyl pyrrolidone surfactant, an alkalinity providing agent, a corrosion inhibitor selected from the group consisting of magnesium ions, zinc ions and mixtures thereof and a carboxylated polymer to maintain said corrosion inhibitor in solution.

36. The concentrate of claim 35 wherein said corrosion inhibitor is in the form of water soluble salts of magnesium or zinc.

37. The concentrate of claim 35 wherein said corrosion inhibitor comprises a mixture of said magnesium and zinc ions.

38. The concentrate of claim 35 wherein said alkalinity providing agent comprises alkali metal carbonate, alkali metal bicarbonate or mixtures thereof.

39. The concentrate of claim 38 wherein said corrosion inhibitor comprises magnesium ions in the form of magnesium oxide.

40. The concentrate of claim 35 which has a pH of about 7.5 to 11.0.

41. The concentrate of claim 35 wherein said metal cleaning composition comprises 20 to 80 wt. % of said alkalinity providing agent, 0.1 to 10 wt. % of said corrosion inhibitor in the form of magnesium or zinc compounds, 0.3 to 2 wt. % of said carboxylated polymer and 0 to 30 wt. % of a hydrotrope.

42. The concentrate of claim 41 wherein said metal cleaning composition comprises 5 to 80 wt. % of the surfactants.

43. The concentrate of claim 41 wherein said metal cleaning composition is free of silicates and said alkalinity providing agent comprises less than 1 wt. % phosphorus.

44. An aqueous metal cleaning composition comprising: 5 to 80 wt. % of an ethoxylated alkyl thiol surfactant having 7 to 20 carbon atoms and ethoxylated with 3 to 15 ethylene oxide units, an N-alkyl pyrrolidone surfactant, 20 to 80 wt. % of an alkalinity providing agent, 0.1 to 10 wt. % of a corrosion inhibitor selected from the group consisting of magnesium ions, zinc ions and mixtures thereof and a carboxylated polymer to maintain said corrosion inhibitor in aqueous solution.

45. The composition of claim 44 wherein said corrosion inhibitor is in the form of water soluble salts of magnesium or zinc.

46. The composition of claim 45 wherein said water soluble salts comprise magnesium chloride and zinc chloride.

47. The composition of claim 44 wherein said alkalinity providing agent comprises alkali metal carbonate, alkali metal bicarbonate or mixtures thereof.

48. The composition of claim 47 wherein said corrosion inhibitor comprises magnesium ions in the form of magnesium oxide.

49. The composition of claim 44 comprising 0.3 to 2 wt. % of said carboxylated polymer and 0 to 30 wt. % of a hydrotrope.

50. The composition of claim 49 wherein said metal cleaning composition is free of silicates and said alkalinity providing agent comprises less than 1 wt. % phosphorus.

51. The composition of claim 44 wherein said carboxylated polymer comprises acrylic acid units.

52. The composition of claim 51 wherein said carboxylated polymer comprises a copolymer having maleic anhydride units.

53. The composition of claim 44 wherein said corrosion inhibitor comprises a mixture of said magnesium and zinc ions.

54. The composition of claim 44 wherein said surfactants do not substantially emulsify contaminants in an aqueous solution of the aqueous metal cleaning composition whereby said contaminants readily separate from said aqueous solution.

55. The composition of claim 44 wherein said ethoxylated alkyl thiol surfactant is present in said composition in amounts relative to said N-alkyl pyrrolidone surfactant of from about 1.0:0.1 to 1.0:2.0 based on the weight of the respective surfactants.

56. An aqueous metal cleaning concentrate comprising: 5–45 wt. % of a metal cleaning composition and the balance water, said metal cleaning composition comprising an alkoxylated thiol surfactant, and an N-alkyl pyrrolidone surfactant, an alkalinity providing agent selected from the group consisting of alkali metal carbonate, alkali metal bicarbonate and mixtures thereof, a corrosion inhibitor in the form of magnesium oxide, and a carboxylated polymer to maintain said corrosion inhibitor in solution.

57. The aqueous metal cleaning concentrate of claim 56, wherein the carboxylated polymer consists of a polycarboxylated copolymer containing acrylic and maleic acid units.

58. The aqueous metal cleaning concentrate of claim 56, wherein the surfactants do not substantially emulsify contaminants in said cleaning concentrate whereby said contaminants readily separate from said cleaning concentrate.

* * * * *